US008807200B2

(12) United States Patent
Nakatsuka

(10) Patent No.: US 8,807,200 B2
(45) Date of Patent: Aug. 19, 2014

(54) ELECTRICALLY DRIVEN INJECTION DEVICE FOR DIE-CASTING MACHINE

(75) Inventor: Yoshihisa Nakatsuka, Akashi (JP)

(73) Assignee: Toyo Machinery & Metal Co., Ltd., Akashi-shi (JP)

( * ) Notice: Subject to any disclaimer, the term of this patent is extended or adjusted under 35 U.S.C. 154(b) by 0 days.

(21) Appl. No.: 14/003,944

(22) PCT Filed: Mar. 6, 2012

(86) PCT No.: PCT/JP2012/055685
§ 371 (c)(1),
(2), (4) Date: Sep. 9, 2013

(87) PCT Pub. No.: WO2012/121250
PCT Pub. Date: Sep. 13, 2012

(65) Prior Publication Data

US 2013/0344187 A1 Dec. 26, 2013

(30) Foreign Application Priority Data

Mar. 10, 2011 (JP) ..... 2011-053292

(51) Int. Cl.
*B22D 17/32* (2006.01)

(52) U.S. Cl.
USPC ..... 164/312

(58) Field of Classification Search
CPC ..... B22D 17/20; B22D 17/32
USPC ..... 164/312, 313, 314, 315
See application file for complete search history.

(56) References Cited

U.S. PATENT DOCUMENTS 7,770,626 B2 * 8/2010 Yashiro et al. ..... 164/72
8,225,842 B2 * 7/2012 Taniguchi ..... 164/312

FOREIGN PATENT DOCUMENTS

JP 2000-33472 A 2/2000
JP 2000-84654 A 3/2000
JP 2007-296550 A 11/2007
JP 2008-296504 A 12/2008
JP 2010-260070 A 11/2010

OTHER PUBLICATIONS

International Search Report dated May 29, 2012 w/ partial English translation (three (3) pages).

* cited by examiner

*Primary Examiner* — Kevin P Kerns
(74) *Attorney, Agent, or Firm* — Crowell & Moring LLP

(57) ABSTRACT

The invention is provided with a first injection electric motor used for low-speed injection and increasing pressure, a second injection electric motor used for high-speed injection, first and second power transmission mechanisms for transmitting rotary motion of the injection electric motors to a screw shaft, first and second clutch mechanisms provided in the power transmission mechanisms, an injection plunger advanced and withdrawn integrally with respect to a nut threaded on the screw shaft, and a controller for controlling the driving of the injection electric motors and the clutch mechanisms. The controller starts the second injection electric motor from a stopped state before the point in time where the high-speed injection step is to commence; and switches the second clutch mechanism from a disengaged state to an engaged state at the point in time where the high-speed injection step is to commence, or at a requisite timing prior thereto.

4 Claims, 5 Drawing Sheets

ELECTRICALLY DRIVEN INJECTION DEVICE FOR DIE-CASTING MACHINE

TECHNICAL FIELD

The present invention relates to an electrically driven injection device provided in a die-casting machine. Particularly, it relates to a unit for controlling the driving of an injection plunger in a step of injecting/filling a molten metal material into a mold cavity.

BACKGROUND ART

A die-casting machine is a molding machine in which an injection plunger is driven to move forward for every shot so as to inject/fill a constant amount of a material of molten metal such as an Al alloy or an Mg alloy into a mold cavity to thereby mold a product with a required shape. In the same manner as an injection molding machine which injects/fills a plastic material into a mold cavity so as to mold a product with a required shape, the die-casting machine injects/fills a molding material into a mold cavity in a low-speed injection step, a high-speed injection step and an intensification step (corresponding to a holding pressure step in the injection molding machine). However, the die-casting machine is characterized in that the injection speed in the high-speed injection step is about one digit higher than that in the injection molding machine. Therefore, in the background art, a hydraulic die-cast machine in which an injection plunger is driven by hydraulic pressure has been the mainstream.

However, the hydraulic die-casting machine is apt to contaminate a molding factory with oil so that the working environment may deteriorate. Therefore, in recent years, electrically driven die-casting machines without such a drawback have been proposed (for example, see Patent Literatures 1 and 2).

An electrically driven injection device disclosed in Patent Literature 1 is provided with two injection electrically driven servo motors 101*a* and 101*b*, and torques of the two injection electrically driven servo motors 101*a* and 101*b* are converted into linear forces of nuts 102*a* and 102*b* by ball screw mechanisms 104*a* and 104*b* consisting of the nuts 102*a* and 102*b* and screw shafts 103*a* and 103*b* threaded thereon so as to move an injection plunger 106 forward/backward by means of a moving member 105 to which the nuts 102*a* and 102*b* are attached integrally, as shown in FIG. 5. In addition, a surge pressure preventing device (hydraulic cylinder 107) is provided between the moving member 105 and the injection plunger 106 so as to prevent excessive surge pressure from acting on a molten metal material in a mold cavity when a high-speed injection step is completed. In this electrically driven injection device, the injection plunger 106 is driven by a resultant force of the two injection electrically driven servo motors 101*a* and 101*b*. Thus, a high injection speed can be obtained. In addition, due to the surge pressure preventing device 107 provided between the moving member 105 and the injection plunger 106, a good product without poor appearance such as burrs can be molded, and a mold or the like can be prevented from being broken by surge pressure.

On the other hand, in an electrically driven injection device disclosed in Patent Literature 2, as shown in FIG. 6, the torque of an injection electrically driven servo motor 201 is transmitted to a screw shaft 204*a* of a ball screw mechanism 204 through a speed reducer 202 and a friction clutch 203 so that an injection plunger 205 can be moved forward/backward by a nut 204*b* of the ball screw mechanism 204 threaded on the screw shaft 204*a*. In this electrically driven injection device, the friction clutch 203 put between an output shaft of the speed reducer 202 and the screw shaft 204*a* of the ball screw mechanism 204 prevents excessive surge pressure from acting on a molten metal material in a mold cavity when a high-speed injection step is completed. Thus, a good product without poor appearance such as burrs can be molded, and a mold or the like can be prevented from being broken by surge pressure.

CITATION LIST

Patent Literature

Patent Literature 1: JP-A-2010-260070
Patent Literature 2: JP-A-2007-296550

SUMMARY OF INVENTION

Technical Problem

However, electrically driven servo motors do not have so high acceleration performance at the time of start-up. It is therefore impossible or very difficult for the electrically driven injection device disclosed in Patent Literature 1 or 2 to execute a requisite high-speed injection step. That is, the injection plunger which is in a stopped state needs to be accelerated to a predetermined forward speed in a short time in order to execute the requisite high-speed injection step. To this end, it is however necessary to use a large electrically driven servo motor with a large thrust force to thereby make the die-casting machine larger in size and higher in cost. For this sake, in fact, it is difficult to use such a large electrically driven servo motor.

The present invention has been accomplished to solve the problem inherent in the background art. An object of the invention is to provide an electrically driven injection device for a die-cast machine capable of performing a requisite high-speed injection step using a small electric servo motor.

Solution to Problem

In order to solve the foregoing problem, the invention is provided with a first injection electric motor used for low-speed injection and intensification, a second injection electric motor used for high-speed injection, a first power transmission mechanism for transmitting rotary motion of the first injection electric motor to a screw shaft of a ball screw mechanism, a second power transmission mechanism for transmitting rotary motion of the second injection electric motor to the screw shaft, a first clutch mechanism provided in the first power transmission mechanism, a second clutch mechanism provided in the second power transmission mechanism, a nut threaded on the screw shaft, a linear motion body holding the nut, an injection plunger having one end linked with the linear motion body, and a controller for controlling start/stop of the first and second injection electric motors and disengagement/engagement of the first and second clutch mechanisms, characterized in that: the controller memorizes points in time where a low-speed injection step, a high-speed injection step and a intensification step are to commence; starts the second injection electric motor from a stopped state before the point in time where the high-speed injection step is to commence; and switches the second clutch mechanism from a disengaged state to an engaged state at the point in time where the high-speed injection step is to commence, or at a point prior thereto and after a point in time where the second injection electric motor is started.

According to this configuration, the second injection electric motor for high-speed injection is started from the stopped state before the point in time where the high-speed injection step is to commence, and the second clutch mechanism for high-speed injection is switched from the disengaged state to the engaged state at or before the point in time where the high-speed injection step is to commence. Accordingly, the rotating speed of the second injection electric motor for high-speed injection can be increased in the stage where the second clutch mechanism is switched from the disengaged state to the engaged state to transmit the drive force of the second injection electric motor for high-speed injection to the screw shaft of the ball screw mechanism. Thus, after the second clutch mechanism is switched from the disengaged state to the engaged state, the acceleration of the injection plunger driven through the ball screw mechanism and the linear motion body can be increased so that the requisite injection step can be performed using a comparatively-low-output injection motor.

In addition, according to the invention, there is provided an electrically driven injection device for a die-casting machine having the aforementioned configuration, characterized in that: the controller starts the first injection electric motor from a stopped state before the point in time where the intensification step is to commence; and switches the first clutch mechanism from a disengaged state to an engaged state at the point in time where the intensification step is to commence, or at a point prior thereto and after a point in time where the first injection electric motor is started.

According to this configuration, the first injection electric motor for low-speed injection and speed increase is started from a stopped state before the point in time where the high-speed injection step is to commence, and the first clutch mechanism for low-speed injection and speed increase is switched from a disengaged state to an engaged state at or before the point in time where the pressure increasing step is to commence. Accordingly, the rotating speed of the first injection electric motor for low-speed injection and speed increase can be increased in the stage where the first clutch mechanism is switched from the disengaged state to the engaged state to transmit the drive force of the first injection electric motor for low-speed injection and speed increase to the screw shaft of the ball screw mechanism. Thus, after the first clutch mechanism is switched from the disengaged state to the engaged state, the acceleration of the injection plunger driven through the ball screw mechanism and the linear motion body can be increased so that the requisite pressure increasing step can be performed using a comparatively-low-output injection motor.

In addition, according to the invention, there is provided an electrically driven injection device for a die-casting machine having the aforementioned configuration, characterized in that: the controller increases a sliding speed of the second clutch mechanism suddenly at an end stage of the high-speed injection step; and next decreases the sliding speed gradually.

According to this configuration, the sliding speed of the second clutch mechanism is increased suddenly at the end stage of the high-speed injection step, and the sliding speed is then decreased gradually. Accordingly, surge pressure which may appear at an early stage of the pressure increasing step can be suppressed so that product failure such as burrs or damage of a mold or the like can be prevented.

Advantageous Effects of Invention

According to the invention, the second injection electric motor for high-speed injection is started from the stopped state before the point in time where the high-speed injection step is to commence, and the second clutch mechanism for high-speed injection is switched from the disengaged state to the engaged state at or before the point in time where the high-speed injection step is to commence. Accordingly, the rotating speed of the second injection electric motor for high-speed injection can be increased in the stage where the second clutch mechanism is switched from the disengaged state to the engaged state to transmit the drive force of the second injection electric motor for high-speed injection to the screw shaft of the ball screw mechanism. Thus, after the second clutch mechanism is switched from the disengaged state to the engaged state, the acceleration of the injection plunger driven through the ball screw mechanism and the linear motion body can be increased so that the requisite injection step can be performed using a comparatively-low-output injection motor.

DESCRIPTION OF EMBODIMENT

An embodiment of an electrically driven injection device according to the invention will be described below with reference to the drawings.

Figure 1:
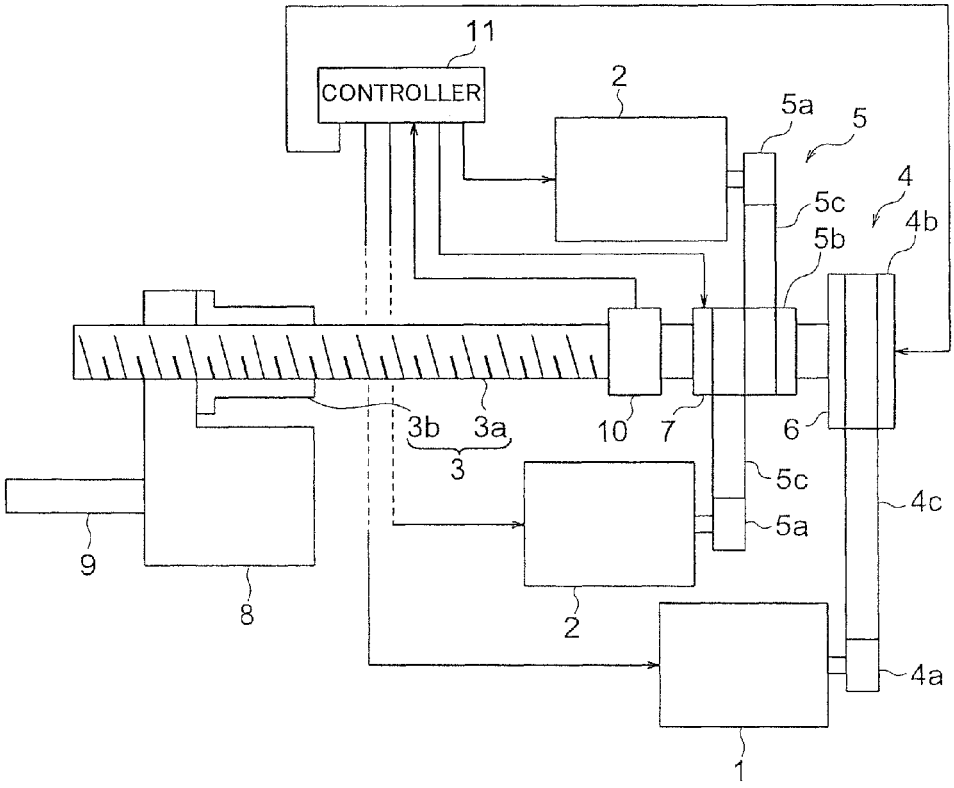
FIG. 1 A configuration diagram of an injection device according to an embodiment.
Figure 2:
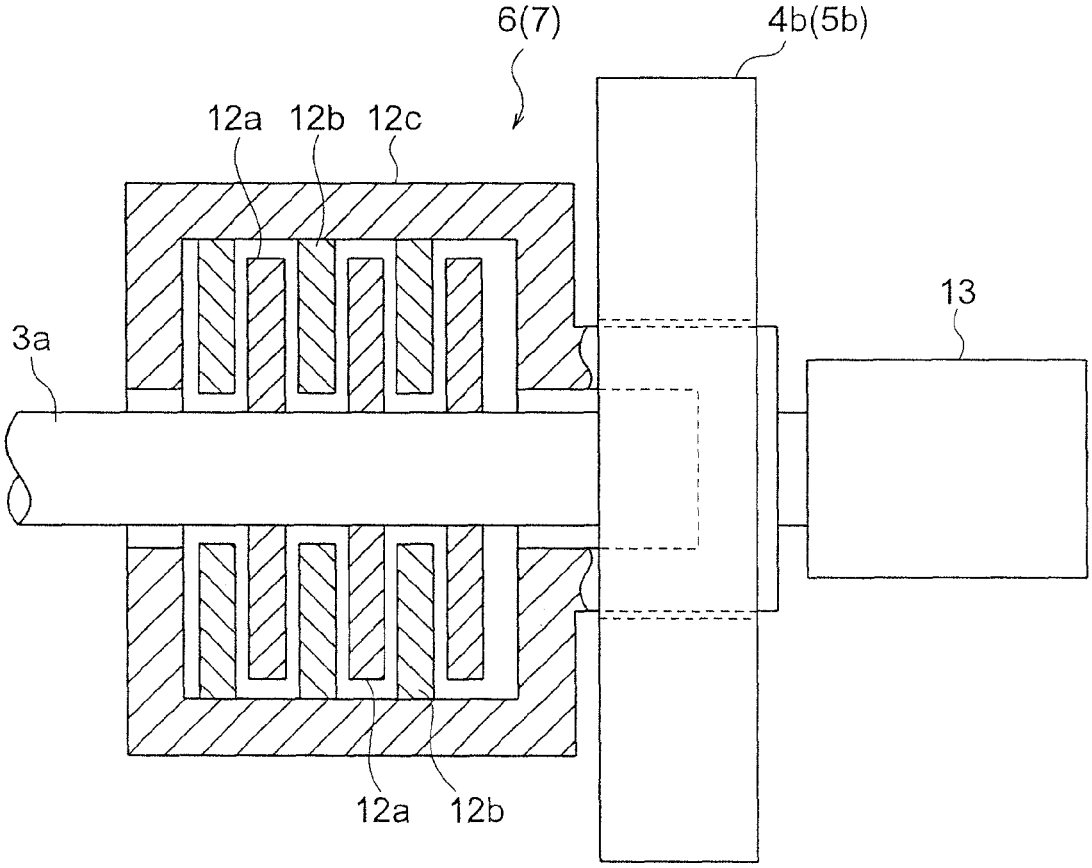
FIG. 2 A configuration diagram of a clutch mechanism provided in the injection device according to the embodiment.

As shown in FIG. 1, the electrically driven injection device according to the embodiment is chiefly constituted by a first injection electric motor 1 which is driven in a low-speed injection step and a intensification step; two second injection electric motors 2 which are driven in a high-speed injection step; a first power transmission mechanism 4 which consists of pulleys 4*a* and 4*b* and a belt 4*c* wound around the pulleys 4*a* and 4*b* in order to transmit rotary motion of the first injection electric motor 1 to a screw shaft 3*a* of a ball screw mechanism; a second power transmission mechanism 5 which consists of pulleys 5*a* and 5*b* and belts 5*c* wound around the pulleys 5*a* and 5*b* in order to transmit rotary motion of the second injection electric motors 2 to the screw shaft 3*a*; a first clutch mechanism 6 which is arranged integrally with the pulley 4*b*; a second clutch mechanism 7 which is arranged integrally with the pulley 5*b*; a nut 3*b* which is threaded on the screw shaft 3*a* and which constitutes the ball screw mechanism 3 together with the screw shaft 3*a*; a linear motion body 8 which holds the nut 3*b*; an injection plunger 9 whose one end is linked with the linear motion body 8; a position sensor 10 such as a rotary encoder, which detects the rotational position of the screw shaft 3*a* and hence the forward/backward position and the speed of the injection plunger; and a controller 11 which controls the start/stop of the first and second injection electric motors 1 and 2 and the disengagement/engagement of the first and second clutch mechanisms 6 and 7.

An electric servo motor with a high thrust force which is, for example, about 120 KN, is used as the first injection electric motor 1 so that a requisite low-speed injection step and a requisite intensification step can be performed. On the other hand, an electric servo motor which has a lower thrust force (for example, 50 KN) than the first injection electric motor 1 but can rotate at a higher speed is used as each second injection electric motor 2 so that a requisite high-speed injection step can be performed. Start/stop, rotating speeds, etc. of these injection electric motors 1 and 2 are controlled by the controller 11.

Timing belts which can transmit the rotations of the electric motors 1 and 2 to the screw shaft 3*a* accurately without sliding on the pulleys 4*a*, 4*b*, 5*a* and 5*b* are preferably used as the belt 4*c* constituting the first power transmission mechanism 4 and the belts 5*c* constituting the second power transmission mechanism 5. Because of this, grooved pulleys on which the timing belts 4*c* and 5*c* can be wound are used as the pulleys 4*a*, 4*b*, 5*a* and 5*b*.

Wet multi-plate clutches are preferably used as the first clutch mechanism 6 and the second clutch mechanism 7 because they are capable of transmitting a high thrust force and superior in durability. Each of these multi-plate clutches constituting the first and second clutch mechanisms 6 and 7 is constituted by a plurality of rotatable clutch plates 12*a* which are attached integrally to the screw shaft 3*a*, a plurality of fixed clutch plates 12*b* which are attached integrally into a casing 12*c* and disposed to face the rotatable clutch plates 12*a* respectively, a clutch changeover electric motor 13 which slides the casing 12*c* along the axial direction of the screw shaft 3*a* so as to change the sliding speed between the rotatable clutch plates 12*a* and the fixed clutch plates 12*b*, and a not-shown ball screw mechanism which converts the rotary motion of the clutch changeover electric motor 13 into the linear motion of the casing 12*c*. Disengagement/engagement, sliding speeds, etc. of these clutch mechanisms 6 and 7 are also controlled by the controller 11.

The controller 11 memorizes the points in time where a mold clamping step, a low-speed injection step, a high-speed injection step, a intensification step, a mold opening step and a product taking-out step are to commence and the points in time where those steps are to be completed, in a memory built in the controller 11. The controller 11 controls driving of each movable portion at a predetermined point in time.

Figure 3:
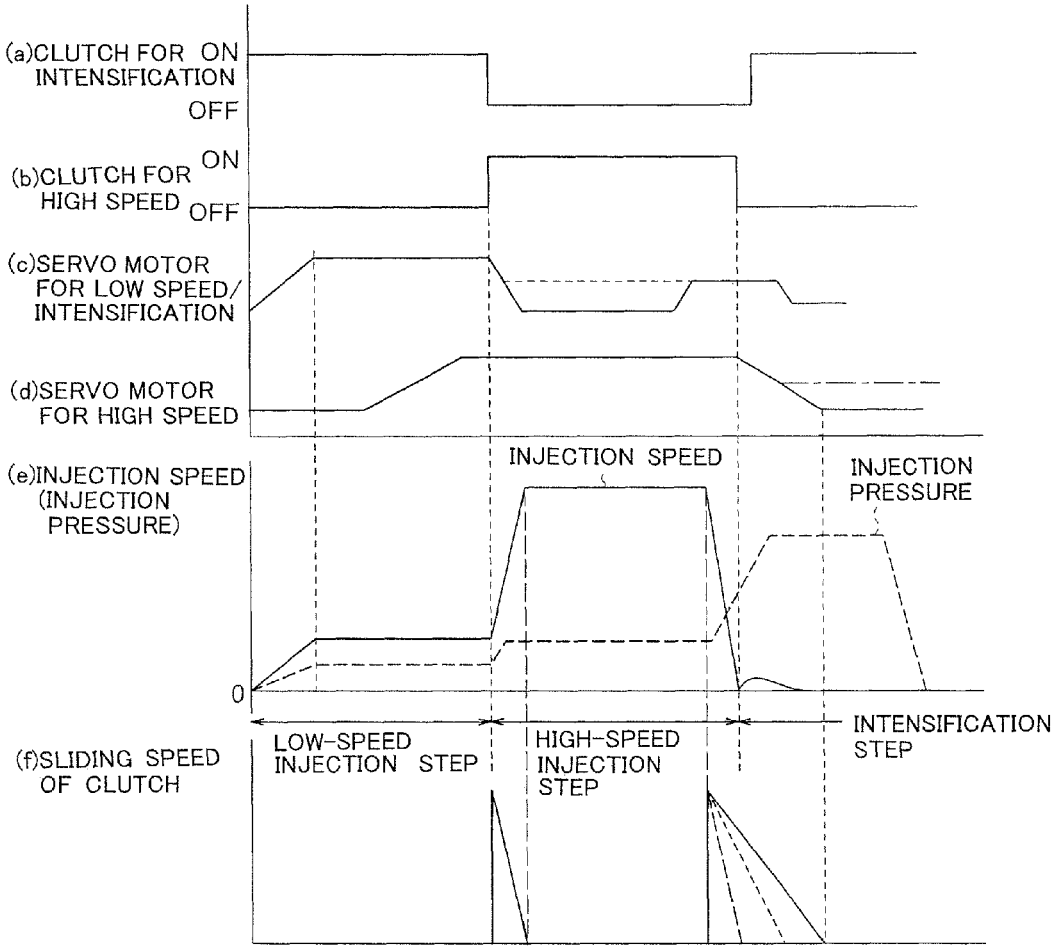
FIG. 3 A timing chart showing the operation of the injection device according to the embodiment.

As for the injection device, the first clutch mechanism 6 is switched to an engaged state (which is a state where the sliding speed is zero or minimal) at or before the point in time where the low-speed injection step is to commence as shown in FIG. 3(*a*), while the first injection electric motor 1 is started from the stopped state at the point in time where the low-speed injection step is to commence as shown in FIG. 3(*c*). On this occasion, the second injection electric motors 2 are kept in the stopped state as shown in FIG. 3(*d*), and the second clutch mechanism 7 is kept in a disengaged state (which is a state where the clutch plates 12*a* and 12*b* are idle or the sliding speed is maximal) as shown in FIG. 3(*b*). As a result, the rotary motion of the first injection electric motor 1 is transmitted to the injection plunger 9 through the ball screw mechanism 3 and the linear motion body 8 so as to move the injection plunger 9 forward at a required low speed. Thus, a molten metal material begins to be injected/filled into a mold cavity. The position where the injection plunger 9 is moved forward and the point in time where the low-speed injection step is completed are determined by the controller 11 based on an output signal of the position sensor 10 imported into the controller 11.

As soon as the position where the injection plunger 9 is moved forward reaches a predetermined position before the point in time where the low-speed injection step is completed, the second injection electric motors 2 are started from the stopped state as shown in FIG. 3(*d*). In consideration of the acceleration performance of the second injection electric motors 2, the point in time where the second injection electric motors 2 are started is set as a point in time where the rotating speeds of the second injection electric motors 2 will reach required high speeds set for carrying out the high-speed injection step at the point in time where the high-speed injection step is to commence. At the point in time where the high-speed injection step is to commence, the second clutch mechanism 7 is switched to the engaged state as shown in FIG. 3(*b*), while the first clutch mechanism 6 is switched from the engaged state to the disengaged state as shown in FIG. 3(*a*), and the first injection electric motor 1 is reduced from a low-speed driven state to a rotating speed corresponding to the intensification step as shown by the broken line in FIG. 3(*c*) or the first injection electric motor 1 is switched to the stopped state as shown by the solid line in FIG. 3(*c*). As a result, as shown in FIG. 3(*e*), the leading edge of the forward moving speed of the injection plunger 9 in the high-speed injection step can be made so sharp that excellent high-speed injection can be carried out using the second injection electric motors 2 which are comparatively small. Incidentally, another configuration in which the second clutch mechanism 7 begins to be switched from the disengaged state to the engaged state before the point in time where the high-speed injection step is to commence may be arranged in consideration of a delay between the disengaged state and the engaged state in the second clutch mechanism 7.

Figure 4:
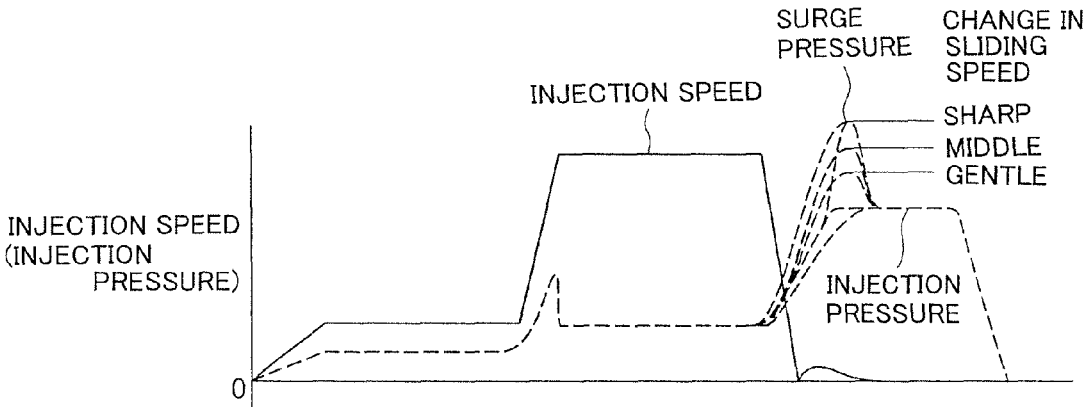
FIG. 4 A graph showing the effect of the injection device according to the embodiment.
Figure 5:
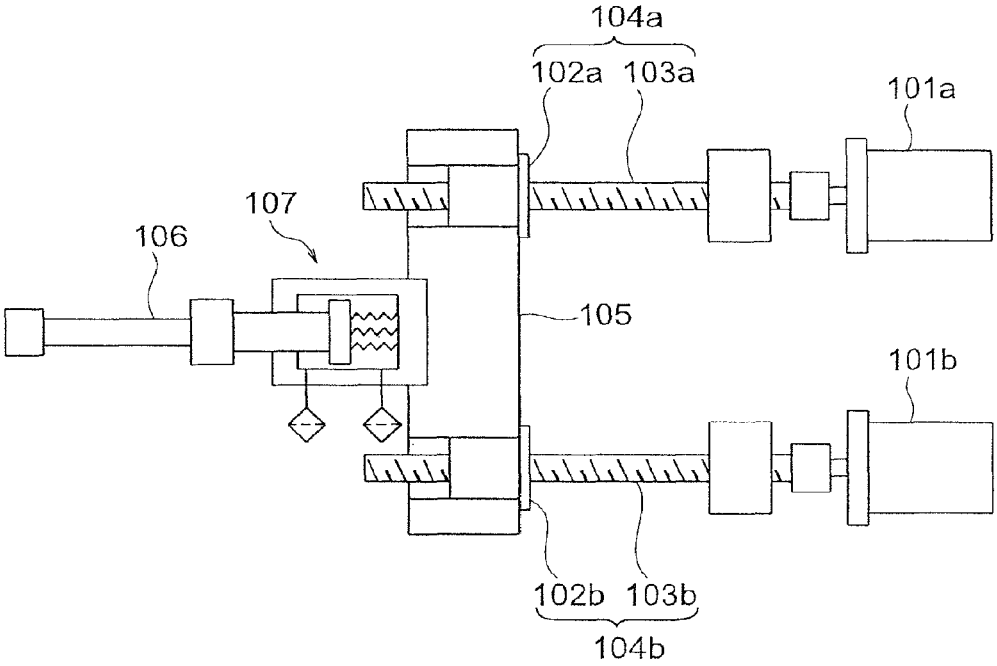
FIG.5 PRIOR ART
FIG. 5 A configuration diagram of an injection device according to a first background-art example.
Figure 6:
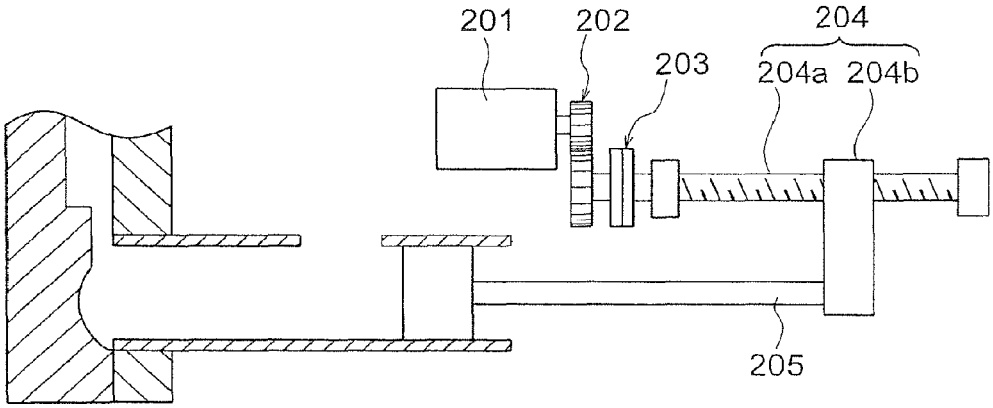
FIG.6 PRIOR ART
FIG. 6 A configuration diagram of an injection device according to a second background-art example.

As soon as the position where the injection plunger 9 is moved forward reaches a predetermined position before the point in time where the high-speed injection step is to be completed, the first injection electric motor 1 is started from the stopped state as shown in FIG. 3(*c*). In consideration of the acceleration performance of the first injection electric motor 1, the point in time where the first injection electric motor 1 is to commence is set as a point in time where the rotating speed of the first injection electric motor 1 will reach a required lower speed set for carrying out the intensification step before the point in time where the intensification step is to commence. At that point in time, as shown in FIG. 3(*f*), the first clutch mechanism 6 is switched from the disengaged state to a sliding rotation state where the clutch plates 12*a* and 12*b* can slide on each other, and the driving of the clutch changeover electric motor 13 is controlled to decrease the sliding speeds of the clutch plates 12*a* and 12*b* gradually (to approach the engaged state). Then, at the point in time where the intensification step is to commence, the second clutch mechanism 7 is switched from the engaged state to the disengaged state as shown in FIG. 3(*b*), while the rotating speeds of the second injection electric motors 2 are reduced from that in the high-speed driven state to the rotating speed corresponding to the intensification step as shown by the alternate long and short dash line in FIG. 3(*d*), or the second injection electric motors 2 are switched from the driven state to the stopped state as shown by the solid line in FIG. 3(*d*). In addition, as shown in FIG. 3(*a*), the first clutch mechanism 6 is switched from the disengaged state to the engaged state after the second clutch mechanism 7 is perfectly brought into the disengaged state. As a result, as shown in FIG. 4, surge pressure which may occur at an early stage of the pressure increasing step can be reduced suitably by adjusting the sliding speed of the first clutch mechanism 6. It is therefore possible to effectively prevent a product failure such as burrs and damage of a mold or the like.

Incidentally, the present invention is an invention chiefly aimed at sharpening the leading edge of the forward moving speed of the injection plunger 9 in the high-speed injection step using the second injection electric motors 2 which are comparatively small. The other points may be removed or selected suitably in accordance with necessity.

INDUSTRIAL AVAILABILITY

The present invention is applicable to an electrically driven injection device provided in a die-cast machine.

REFERENCE SIGNS LIST

1 first injection electric motor
2 second injection electric motor
3 ball screw mechanism
3*a* screw shaft
3*b* nut
4 first power transmission mechanism
4*a*, 4*b* pulley
4*c* belt
5 second power transmission mechanism
5*a*, 5*b* pulley
5*c* belt
6 first clutch mechanism
7 second clutch mechanism
8 linear motion body
9 injection plunger
10 position sensor
11 controller
12*a* rotatable clutch plate
12*b* fixed clutch plate
12*c* casing

The invention claimed is:

1. An electrically driven injection device for a die-casting machine, comprising a first injection electric motor used for low-speed injection and intensification, a second injection electric motor used for high-speed injection, a first power transmission mechanism for transmitting rotary motion of the first injection electric motor to a screw shaft of a ball screw mechanism, a second power transmission mechanism for transmitting rotary motion of the second injection electric motor to the screw shaft, a first clutch mechanism provided in the first power transmission mechanism, a second clutch mechanism provided in the second power transmission mechanism, a nut threaded on the screw shaft, a linear motion body holding the nut, an injection plunger having one end linked with the linear motion body, and a controller for controlling start/stop of the first and second injection electric motors and disengagement/engagement of the first and second clutch mechanisms, wherein:

the controller memorizes points in time where a low-speed injection step, a high-speed injection step and an intensification step are to commence; starts the second injection electric motor from a stopped state before the point in time where the high-speed injection step is to commence; and switches the second clutch mechanism from a disengaged state to an engaged state at the point in time where the high-speed injection step is to commence, or at a point prior thereto and after a point in time where the second injection electric motor is started.

2. An electrically driven injection device for a die-casting machine according to claim 1, wherein: the controller starts the first injection electric motor from a stopped state before the point in time where the intensification step is to commence; and switches the first clutch mechanism from a disengaged state to an engaged state at the point in time where the intensification step is to commence, or at a point prior thereto and after a point in time where the first injection electric motor is started.

3. An electrically driven injection device for a die-casting machine according to claim 2, wherein: the controller increases a sliding speed of the second clutch mechanism suddenly at an end stage of the high-speed injection step; and next decreases the sliding speed gradually.

4. An electrically driven injection device for a die-casting machine according to claim 1, wherein: the controller increases a sliding speed of the second clutch mechanism suddenly at an end stage of the high-speed injection step; and next decreases the sliding speed gradually.

* * * * *